US007089889B2

(12) United States Patent
Johnson et al.

(10) Patent No.: US 7,089,889 B2
(45) Date of Patent: Aug. 15, 2006

(54) GENERATOR HAVING A PLASTIC FRAME

(75) Inventors: Andrew J. Johnson, Kearney, NE (US); Jere B. Albright, Jr., Kearney, NE (US); Saeid Shokrzadeh, Kearney, NE (US)

(73) Assignee: Powermate Corporation, Aurora, IL (US)

( * ) Notice: Subject to any disclaimer, the term of this patent is extended or adjusted under 35 U.S.C. 154(b) by 10 days.

(21) Appl. No.: 10/845,837

(22) Filed: May 14, 2004

(65) Prior Publication Data

US 2005/0252459 A1 Nov. 17, 2005

(51) Int. Cl.
*F02B 53/00* (2006.01)

(52) U.S. Cl. ..... 123/2; 123/198 E

(58) Field of Classification Search ..... 123/200, 123/2, 198 E; 290/1 A
See application file for complete search history.

(56) References Cited

U.S. PATENT DOCUMENTS 3,832,901 A * 9/1974 Girvin, III. ..... 73/325
5,121,715 A * 6/1992 Nogami et al. ..... 123/41.7
6,313,543 B1 * 11/2001 Frank ..... 290/1 A
6,742,995 B1 6/2004 Wood et al.
6,758,169 B1 * 7/2004 Suzuki et al. ..... 290/1 A
6,869,086 B1 * 3/2005 Sadow ..... 280/37
6,901,874 B1 * 6/2005 Lo ..... 114/218
2004/0168654 A1 * 9/2004 Radtke ..... 123/2
2005/0092155 A1 * 5/2005 Phillips et al. ..... 83/581

OTHER PUBLICATIONS

Yanmar Co., Ltd., "Yanmar Air-Cooled Diesel Engine L-E Series: Operation Manual", 24 pgs.

* cited by examiner

*Primary Examiner*—Tony M. Argenbright
*Assistant Examiner*—Katrina Harris
(74) *Attorney, Agent, or Firm*—Levdig, Voit & Mayer, Ltd

(57) ABSTRACT

A generator having a plastic frame. The frame includes plastic panels surrounding the engine and alternator assembly for the generator, providing an enclosure for the engine and alternator assembly and permitting additional features to be added to the frame without adding additional pieces. A retractable cord wrap folds into and out of recesses in one or more panels of the generator. An oil drain chute is provided in one portion of the frame. A retractable handle is extendable from a first recessed position in which the handle is substantially contained within the frame for the generator to an extended position in which the handle extends outward from the frame. A fuel gauge extends along the outer portion of a fuel tank and is formed from a translucent tube.

28 Claims, 4 Drawing Sheets

GENERATOR HAVING A PLASTIC FRAME

TECHNICAL FIELD OF THE INVENTION

The present invention relates generally to generators, and more particularly to portable generators.

BACKGROUND OF THE INVENTION

In general, a generator is a machine by which mechanical energy is changed into electrical energy. Typically, generators include an internal combustion engine that burns gasoline, diesel, or propane to produce 120 or 240 volt sine-wave power. Contemporary generators are fuel efficient, and can last for several hours on a tank of fuel.

Many contemporary generators are portable so that they may be stored in one location, such as inside a garage, and moved to a second location, such as outside of buildings, for operation. To this end, the portable generators often include wheels and a handle, because generators are very often too heavy for comfortable lifting. In fact, a typical generator weighs 200 pounds or more, so moving such a generator can be difficult if wheels are not provided.

In general, the design of prior art portable generators is primarily functional. A metal frame, formed of steel tubing, is provided in which or on which the generator and fuel tank are mounted. Handles extend outward from the steel frame and wheels are attached to the steel frame. A control panel is provided for operation of the generator.

SUMMARY OF THE INVENTION

The following presents a simplified summary of some embodiments of the invention in order to provide a basic understanding of the invention. This summary is not an extensive overview of the invention. It is not intended to identify key/critical elements of the invention or to delineate the scope of the invention. Its sole purpose is to present some embodiments of the invention in a simplified form as a prelude to the more detailed description that is presented later.

In accordance with an embodiment, a generator is provided having a plastic frame. The plastic frame provides an aesthetically pleasing outer appearance for the generator, and permits the frame to be configured as an enclosure for the generator. In accordance with an embodiment, the frame includes plastic panels surrounding the generator, providing an enclosure for the engine and alternator assembly and permitting additional features to be added to the frame without adding additional pieces. For example, an integral console may be provided on one or more of the panels. In addition to providing an enclosure, the plastic panels provide support for the engine and alternator assembly.

In accordance with another embodiment, a plastic base is provided on which the engine and alternator assembly is mounted. This base permits assembly of the engine and alternator assembly and other internal components of the generator on the base, and then attachment of that base to the panels and other structure for the generator.

In accordance with an embodiment, a retractable cord wrap is provided that folds into and out of recesses in one or more panels of the generator. In an embodiment, the retractable cord wrap may be folded outward so that a cord may be wrapped around one or more brackets that extend outward from the panels.

In accordance with another embodiment, an oil drain chute is provided in one portion of the frame. The oil drain chute extends from under the engine to outside the frame and is positioned beneath a drain plug for the engine. Removal of the oil plug allows the oil to drain into the oil drain chute and flow outside the frame, providing a clean and convenient method for changing the oil in the generator. The oil drain chute may be provided, for example, in one of the panels in the enclosure for the generator.

In accordance with another embodiment, a retractable handle is provided for a generator. The retractable handle is extendable from a first recessed position in which the handle is substantially contained within the frame for the generator to an extended position in which the handle extends outward from the frame. A lock may be provided for locking the handle in the outer position.

In accordance with another embodiment, a fuel gauge is provided that extends along the outer portion of a fuel tank. The fuel gauge may be, for example, a translucent tube that extends along the outside of the fuel tank and is connected at top and bottom locations on the fuel tank so that a fuel level within the translucent tubing is the same as the fuel level in the fuel tank. If desired, the translucent tubing may be connected to a fuel line for the engine. The translucent tubing may be integrated into the side of the fuel tank so as to provide an aesthetically pleasing fuel gauge. If desired, a decal having indicia thereon may be provided for holding the translucent tubing in place.

Other features of the invention will become apparent from the following detailed description when taken in conjunction with the drawings, in which:

DETAILED DESCRIPTION

In the following description, various embodiments of the present invention will be described. For purposes of explanation, specific configurations and details are set forth in order to provide a thorough understanding of the embodiments. However, it will also be apparent to one skilled in the art that the present invention may be practiced without the specific details. Furthermore, well-known features may be omitted or simplified in order not to obscure the embodiment being described.

Figure 1:
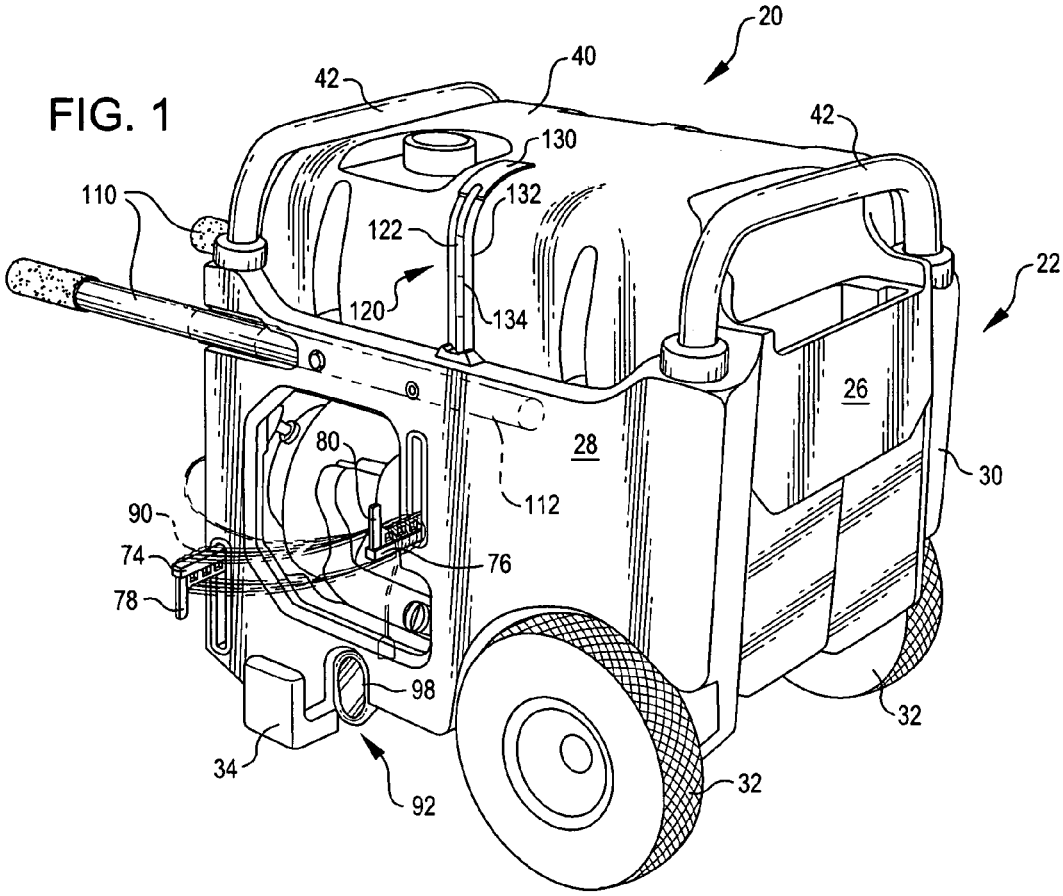
FIG. 1 is a side, rear perspective view of a generator in accordance with an embodiment of the invention.

Referring now to the drawings, in which like reference numerals represent like parts throughout the several views, FIG. 1 shows a generator 20 incorporating an embodiment of the invention. Briefly described, the generator 20 includes a novel frame 22 that is formed of plastic.

Figure 2:
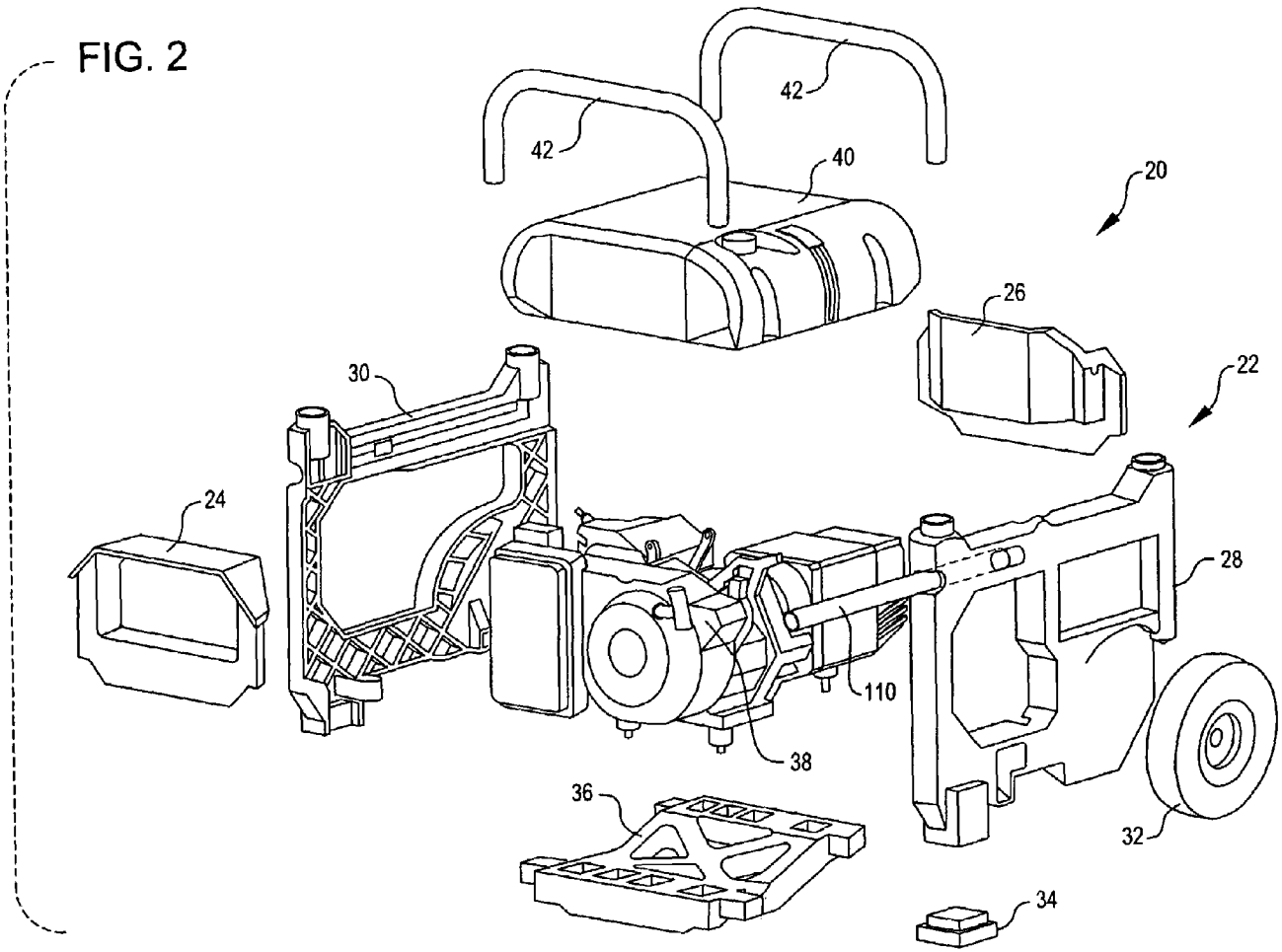
FIG. 2 is an exploded perspective view of a frame for the generator of FIG. 1.

Turning now to FIG. 2, the frame 22 includes a front panel 24, a back panel 26, a right panel 28, and a left panel 30. In accordance with an embodiment, each of these panels 24, 26, 28, and 30 is connected together and forms the frame 22. Thus, unlike prior art generators, the frame 22 is formed from plastic parts, the parts are shaped as panels, and the panels are connected to form an enclosure or outer casing for the generator. As can be seen in FIG. 2, especially with reference to the left panel 30, each of the panels 24, 26, 28, 30 may be ribbed for extra support to provide rigid structure for the frame 22. The panel pieces may be connected together via a suitable manner, such as by bolts, fasteners, interlocking pieces, glue, other attachment mechanisms, or any combination thereof.

In the embodiment shown, the frame 22 includes wheels 32 mounted at a back portion of the frame 22, and feet 34 at a front portion of the frame 22. Additional wheels may be provided, or the structure or arrangement of the frame 22 may be altered as desired. A base 36, which may also be formed of plastic, is provided that extends along a lower portion of the frame 22 and receives an engine and alternator assembly 38 for the generator 20. The base receives the weight of the engine and alternator assembly 38, and may be used for a build of the internal components of the generator 20, to which the frame is added. Alternatively, a base may be provided that is formed of metal, such as metal bars or a metal plate.

A fuel tank 40 extends over the engine and alternator assembly 38 and the top of the frame 22. In the embodiment shown, a pair of grip bars 42 are provided at the top of the frame 22 and on opposite sides of the fuel tank 40. These grip bars 42 may be used, for example, by a pair of users to lift the generator 20, or may be used to push the generator 20 to a desired location. The grip bars may be formed of tubular steel, plastic, or another suitable material. The grip bars 42 fit into sockets (not shown) in the right and left panels 28, 30. The grip bars 42 may extend, for example, three to four inches into the right and left panels 28, 30, and may be attached in a suitable manner, for example by fasteners, adhesive, and/or friction fitting.

The plastic frame 22 of the present invention provides an aesthetically pleasing enclosure for the generator 20. The panels 24, 26, 28, 30 and the base 36 may be configured as desired to arrange components of the generator 20 and to provide functions on the outside of the generator 20. For example, in the embodiment shown, the back panel 26 is configured so that it serves as a cargo bin, and the left and right panels 30, 28 include openings for providing access and airflow to the engine and alternator assembly 38.

The right and left panels 28, 30, the grip bars 42, and the base 36 support the generator 20 in the embodiment shown. However, in an alternate embodiment, the grip bars 42 may be replaced with plastic parts and the entire generator would be supported by a plastic frame.

In an embodiment, the plastic frame 22 is formed of a polymer, for example a polyolefin, such as polypropylene or polyethylene. Other polymers may be used.

Figure 3:
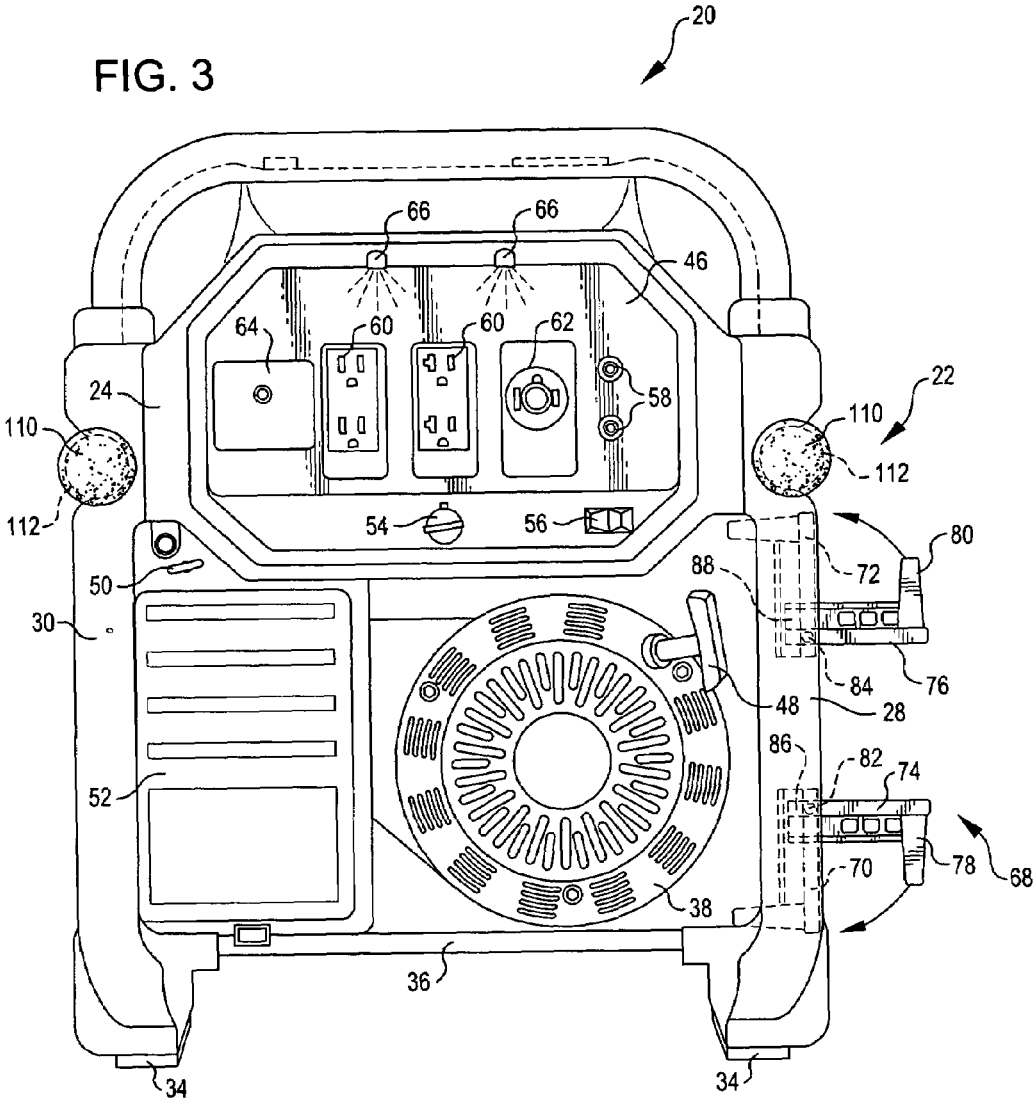
FIG. 3 is a front view of the generator of FIG. 1.

In the embodiment shown, the front panel 24 is configured to receive a control panel 46 (FIG. 3). In accordance with an embodiment, the control panel 46 and other user-interactive features of the engine and alternator assembly 38 are all positioned at the front of the generator 20. This configuration is in contrast to prior art generators, which include a recoil starter and/or a choke lever for the engine at an opposite side, or at least a different side, of the generator from a control panel for the generator. In contrast to this configuration, the generator 20 includes many of the operation components of the engine and alternator assembly 38 at one side, in the embodiment shown, the front. For example, the engine recoil starter 48 is positioned at the front, as well as the engine choke lever 50, and an engine air cleaner 52. The control panel 46 is located just above these items, and includes a fuel on/off switch 54, an engine on/off switch 56, circuit breakers 58, receptacles 60, a twist lock receptacle 62, a printed circuit board 64, and other controls for the generator 20.

In accordance with an embodiment, the control panel 46 includes one or more light emitting diodes (LEDs) 66 (in the embodiment shown, two are provided) that are positioned above the control panel 46 and project light down onto the control panel 46. The LEDs 66 require very little power to operate, and provide sufficient lighting for the control panel 46 so that an operator or a user can see the controls and other features on the control panel 46 without having additional light. In an embodiment, the LEDs 66 are bright LEDs, such as Nichia NSPW500BS white LED, or may be another ultrabright white LED.

In accordance with an embodiment, a retractable cord wrap 68, best shown in FIG. 3, is provided for the generator 20. In the embodiment shown, the retractable cord wrap 68 is mounted in recesses 70, 72 in the right panel 28. However, the retractable cord wrap may be situated on another panel, and/or may extend across multiple panels as desired. The retractable cord wrap 68 includes a pair of brackets 74, 76, mounted respectively in the recesses 70, 72. Each of the brackets 74, 76 includes a respective retainer 78, 80 and pivot pin 82, 84. The brackets 74, 76 are mounted so that they rotate about the pivot pins 82, 84 and are positioned relative to the pivot pins 82, 84 so that extensions 86, 88 are positioned on opposite sides from the retainers 78, 80.

In operation, the brackets 74, 76 are stored in the recesses 70, 72, as is shown in phantom in FIG. 3. However, if a user desires to use the retractable cord wrap 68, the user may rotate the brackets 74, 76 outward, for example, by pressing the extensions 86, 88 to cause the retainers 78, 80 to rotate outward.

Once rotated outward, in the embodiment shown, the retainers 78, 80 extend upward and downward, respectively. However, the retainers 78, 80 may be otherwise situated to receive a cord wrapped thereon, or different structures may be provided for retaining a cord. Brackets may also be provided without a retaining structure. However, by supplying a retaining structure such as the retainers 78, 80, a cord 90 may be wrapped on the brackets 74, 76 and is less likely to fall off the brackets 74, 76, because it is held in place by the retainers 78, 80.

If desired, a lock (not shown) or other feature may be provided for maintaining the brackets 74, 76 in the recesses 70, 72. For example, a protrusion may be provided within the recesses 70, 72 that engages the brackets 74, 76 and locks them into position.

Figure 4:
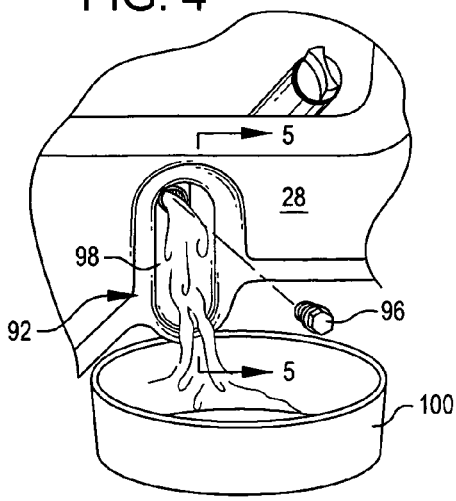
FIG. 4 is a partial cut-away view of the generator of FIG. 1, showing an oil drain chute in accordance with an embodiment of the invention.

In accordance with an embodiment, an oil drain chute 92 (FIGS. 4 and 5) is provided for the generator 20. For prior art generators, the engine is mounted in the center of a metal frame. When oil is changed in the engine, an oil plug for the engine is pulled and the oil is allowed to spill, sometimes on the frame and sometimes to a pan positioned below the frame. Positioning the pan underneath the frame is difficult, because adequate space is typically not available under the metal frame. In addition, oil dripping on the frame can cause a mess. The oil drain chute 92 solves many of these problems.

Figure 5:
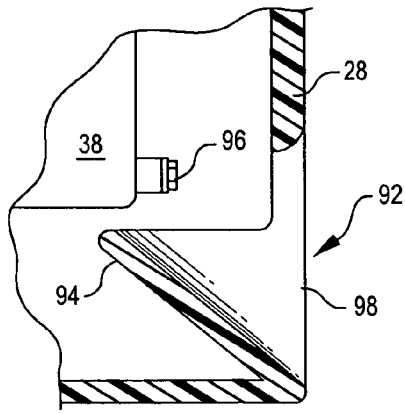
FIG. 5 is a sectional view taken along the section lines 5—5 of FIG. 4.

As can be seen in FIG. 5, the oil drain chute 92 includes an extension 94 that extends inward, relative to the generator 20, from the right panel 28. Preferably, this extension 94 extends beyond a position where an oil plug 96 for the engine is positioned. More preferably, this extension extends far enough so that when the oil plug 96 is removed and oil is draining from the engine, the oil is captured by the extension 94 even at end of the draining process, where the oil clings to the engine side and has a tendency to flow backward under the engine.

The remainder of the oil drain chute 92 from a distal end of the extension 94 downward in a chute formation to an opening 98 on the front of the right panel 28. A user may position a pan 100 under this opening 98 to capture oil flowing through the oil drain chute 92.

In use, a user simply removes the oil plug 96, e.g., by accessing the oil plug 96 through the top of the opening 98. The oil then drains into the oil drain chute 92 from the extension 94 and out through the opening 98. This oil may drain, for example, into the pan 100.

In accordance with an embodiment, a retractable, handle 110 (e.g., FIG. 1) is provided for the generator 20. Briefly described, the retractable handle 110 is arranged and configured so that it may be stored in a recessed position within a pocket 112 in one of the left or right panels 30, 28, and may be pulled outward for use as is shown in FIG. 1.

In the embodiment shown in the drawings, two retractable handles 110 are provided, one each in the left and right panels 30, 28. In an alternative embodiment, a single retractable handle, for example a U-shaped handle, may be provided that extends around and is received in pockets in both of the two opposite panels 30, 28. In still another embodiment, a single retractable handle may be provided that is received in only one of the panels, or is attached to other positions on the generator 20.

Figure 6:
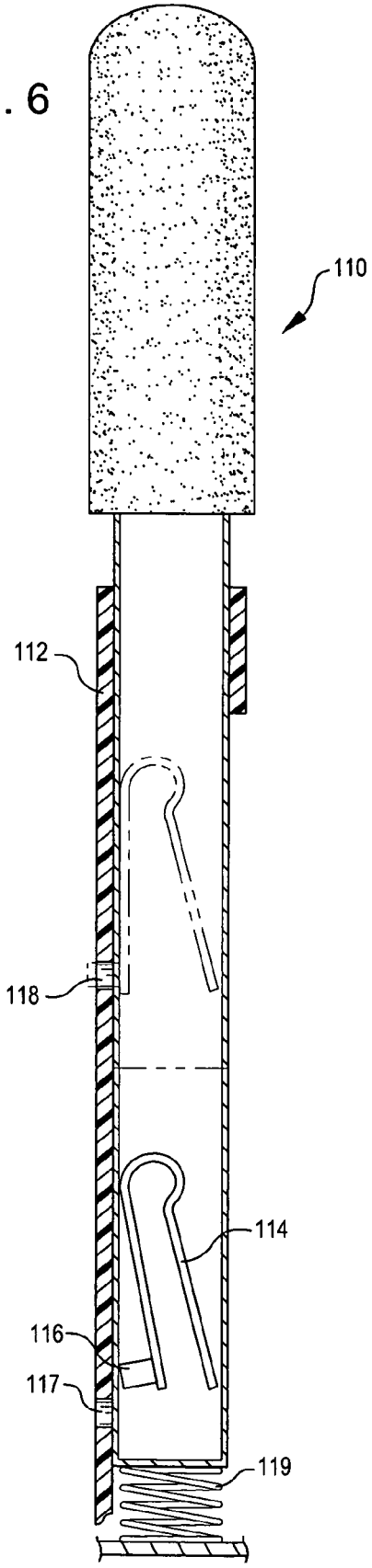
FIG. 6 is a partial cut-away view of a retractable handle for the generator of FIG. 1 in accordance with an embodiment of the invention.

In accordance with an embodiment, the retractable handle 110 is releasably lockable in the extended position. To provide this function, in accordance with an embodiment, a spring lever 114 (FIG. 6) is provided internally within the retractable handle 110. The spring lever 114 includes a detent 116 that is biased outward by the spring lever 114. An opening 118 is provided in the pocket 112 and is positioned so that it aligns with the detent 116. Thus, when the retractable handle 110 is pulled outward to the extended position, the detent 116 snaps into the opening 118, preventing further movement outward of the retractable handle 110, and preventing retraction of the retractable handle 110.

To retract the retractable handle 110, a user presses on the detent 116, releasing the detent 116 from the opening 118, and permitting the user to press the retractable handle 110 back into the pocket 112. Other locking devices may be provided for the retractable handle 110, including, but not limited to, a swedged fitting, a rotate-and-lock fitting, or other suitable structures.

In accordance with an embodiment, a second detent opening 117 is provided for locking the retractable handle 110 in the retracted position. In addition, a spring 119 is provided that urges the retractable handle 110 outward when the detent 116 is removed from the opening 117. In this manner, the retractable handle 110 may be fully received in one of the panels of the generator 20, and access to the retractable handle is provided by pressing the detent 116 when the detent is in the second opening 117.

Figure 7:
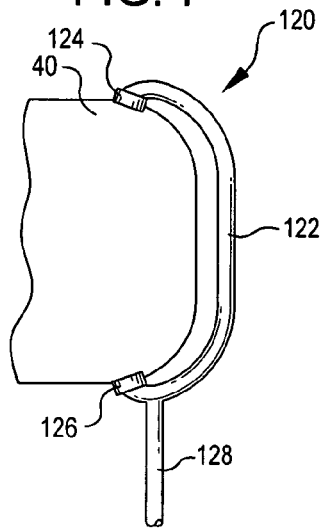
FIG. 7 is a side, partial cut-away view of a fuel tank and fuel gauge for the generator of FIG. 1 in accordance with an embodiment of the invention.

In accordance with an embodiment, a novel fuel gauge 120 is provided for the fuel tank 40 of the generator 20. In the embodiment shown, the fuel gauge 120 includes translucent tubing 122 that extends along an outer portion of the fuel tank 40 and provides a reading of the level of fuel within the fuel tank 40. As can be seen in FIG. 7, the translucent tubing 122 is attached to an upper surface of the fuel tank 40 by an upper fitting (not shown, but known in the art) and a sealed bushing 124. The translucent tubing 122 extends downward to a lower sealed bushing 126 positioned at a lower part of the fuel tank 40, which alternatively may extend to below the fuel tank 40. In the embodiment shown, a fuel line 128 for the engine is connected, for example via a T-connector to a bottom portion of the translucent tubing 122. The fuel line 128 may otherwise be connected to the translucent tubing 122, and the embodiment in the drawing is given as an example.

The upper sealed bushing 124, the lower sealed bushing 126, and the translucent tubing 122 form a continuous fluid circuit with the fuel tank 40. As a result, the fuel level in the translucent tubing 122 resides at the same level as the fuel in the fuel tank 40, giving a clear indication of fuel level in the fuel tank 40. This fuel level may be easily read by a user standing adjacent to the generator 20.

In the embodiment shown in FIG. 1, the upper sealed bushing 124 is covered by a cap 130. In addition, the translucent tubing 122 is recessed into a slot molded into the side of the fuel tank 40 and is held in place by an adhesive strip or decal 132. The decal 132 may include sufficient indicia or graphics to indicate the level of fuel in the fuel tank 40. The decal 132 may include a clear stripe 134 extending along its length, for example, in a center portion, that permits viewing of the translucent tubing 122.

The decal 132 may be attached to the fuel tank 40 with an aggressive adhesive. In addition, to prevent removal of the decal 132, a top portion of the decal 132 may be positioned below the cap 130, and a lower portion of the decal 132 may be position so that it is covered and held in place by the right panel 28.

Other variations are within the spirit of the present invention. Thus, while the invention is susceptible to various modifications and alternative constructions, a certain illustrated embodiment thereof is shown in the drawings and has been described above in detail. It should be understood, however, that there is no intention to limit the invention to the specific form or forms disclosed, but on the contrary, the intention is to cover all modifications, alternative constructions, and equivalents falling within the spirit and scope of the invention, as defined in the appended claims.

All references, including publications, patent applications, and patents, cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) are to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. The term "connected" is to be construed as partly or wholly contained within, attached to, or joined together, even if there is something intervening. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate embodiments of the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A generator, comprising:

an engine and alternator assembly; and a plastic frame extending around the engine and alternator assembly, the plastic frame comprising a plurality of panels positioned about the engine and alternator assembly and supporting the engine and alternator assembly independent of a metal structure, the plastic frame comprising a panel with an integrally formed cargo bin.

2. The generator of claim 1, wherein the plurality of panels form an enclosure around the engine and alternator assembly.

3. A generator, comprising:

an engine and alternator assembly; and a plastic frame extending around the engine and alternator assembly, the plastic frame comprising a plurality of panels positioned about the engine and alternator assembly and supporting the engine and alternator assembly independent of a metal structure, the plastic frame comprising a panel having an oil drain chute, the oil drain chute being configured and arranged to receive oil draining from the engine and alternator assembly and to direct the oil to outside the frame.

4. A generator, comprising:

an engine and alternator assembly; and a plastic frame extending around the engine and alternator assembly, the plastic frame comprising a plurality of panels positioned about the engine and alternator assembly and supporting the engine and alternator assembly independent of a metal structure, the frame comprising a first end, and wherein the engine and alternator assembly comprises a choke positioned at the first end and an engine recoil starter positioned at the first end, and wherein the frame further comprises a control panel for operating the generator, the control panel positioned at the first end.

5. A generator, comprising:

an engine and alternator assembly; and a plastic frame extending around the engine and alternator assembly, the plastic frame comprising a plurality of panels positioned about the engine and alternator assembly and supporting the engine and alternator assembly independent of a metal structure, the frame comprising a retractable handle.

6. A generator, comprising:

a frame having a first side;

a engine and alternator assembly comprising:

a choke positioned at the first side of the frame; and an engine recoil starter positioned at the first side of the frame; and a control panel for operating the generator, the control panel positioned at the first side of the frame.

7. The generator of claim 6, wherein the control panel comprises at least one light emitting diode for illuminating the control panel.

8. A generator, comprising:

a frame; and a retractable cord wrap comprising at least two brackets that fold into and out of the frame and, when folded out of frame, are arranged so that a cord may be wrapped on said at least two brackets.

9. The generator of claim 8, wherein the frame comprises at least one panel, and wherein the retractable cord wrap is foldable outward from said at least one panel.

10. A generator, comprising:

a engine having an oil drain opening;

a frame for supporting the engine; and an oil drain chute, connected to the frame and extending under the drain opening and configured and arranged to catch and direct oil flowing from the oil drain opening.

11. The generator of claim 10, wherein the oil drain chute is configured and arranged to direct oil to outside the frame.

12. A generator, comprising:

a engine having an oil drain opening;

a frame for supporting the engine and comprising a panel; and an oil drain chute, connected to the frame and extending under the drain opening and configured and arranged to catch and direct oil flowing from the oil drain opening, wherein the oil drain chute extends through the panel.

13. The generator of claim 12, wherein the oil drain chute is formed integral with the panel.

14. The generator of claim 13, wherein the panel comprises plastic.

15. A generator, comprising:

a frame comprising at least one panel; and a retractable handle that is extendable from a first recessed position in which the handle is substantially contained within the panel for the generator to an extended position in which the handle extends outward from the panel.

16. The generator of claim 15, further comprising a device for locking the handle in the extended position.

17. The generator of claim 15, wherein the panel comprises a side edge, and a pocket extending along the panel, and wherein the handle is slidably mounted in the pocket so that the handle may slide axially within the pocket from the first position where the handle is substantially positioned behind the side edge to the extended position where a gripping portion of the handle is positioned beyond the side edge.

18. A fuel tank, comprising:

a groove on an outer edge of the fuel tank; and a translucent continuous tube fit in the groove and that extends along the outside of the fuel tank and is connected in fluid communication with the tank at top and bottom locations on the fuel tank so that a fuel level within the translucent tubing is the same as the fuel level in the fuel tank.

19. The fuel tank of claim 18, wherein the translucent tubing is connected to a fuel line for an engine.

20. The fuel tank of claim 18, further comprising a decal having indicia thereon and for holding the translucent tubing in the groove.

21. A generator, comprising:

a engine and alternator assembly;

a frame for supporting the engine, the frame comprising at least one panel; and a retractable handle that is movable between an extended position where the retractable handle may be used as a handle and a retracted position where the retractable handle is retracted within the at least one panel.

22. The generator of claim 21, wherein the retractable handle is fully received in the panel in the retracted position.

23. The generator of claim 22, further comprising a spring for biasing the retractable handle out of the retracted position.

24. The generator of claim 23, further comprising a lock for locking the handle in the retracted position.

25. The generator of claim 24, further comprising a lock for locking the handle in the outer position.

26. The generator of claim 21, further comprising a lock for locking the handle in the retracted position.

27. The generator of claim 21, further comprising a lock for locking the handle in the outer position.

28. The generator of claim 21, wherein the panel comprises a side edge, and a pocket extending along the panel, and wherein the handle is slidably mounted in the pocket so that the handle may slide axially within the pocket from the retracted position where the handle is substantially positioned behind the side edge to the extended position where a gripping portion of the handle is positioned beyond the side edge.

* * * * *